US005385095A

United States Patent [19]

Waizmann

[11] Patent Number: 5,385,095

[45] Date of Patent: Jan. 31, 1995

[54] CLEANING APPARATUS FOR A CYLINDER OF A ROTARY PRINTING MACHINE

[75] Inventor: Franz Waizmann, Gessertshausen, Germany

[73] Assignee: Baldwin-Gegenheimer GmbH, Augsburg, Germany

[21] Appl. No.: 25,042

[22] Filed: Mar. 1, 1993

[30] Foreign Application Priority Data

Feb. 28, 1992 [DE] Germany ..... 4206181

[51] Int. Cl.[6] ..... B41F 35/00

[52] U.S. Cl. ..... 101/424; 101/425

[58] Field of Search ..... 101/424, 425, 423

[56] References Cited

U.S. PATENT DOCUMENTS

| | | | |
|---|---|---|---|
| 1,378,278 | 5/1921 | Roberts | 101/423 |
| 3,762,950 | 10/1973 | Royka | 101/425 |
| 5,086,701 | 2/1992 | Gasparrini et al. | 101/425 |
| 5,099,758 | 3/1992 | Hassler et al. | 101/424 |

FOREIGN PATENT DOCUMENTS

| | | | |
|---|---|---|---|
| 0422400A2 | 4/1991 | European Pat. Off. . | |
| 2159115 | 11/1971 | Germany | 101/425 |
| 0004948 | 1/1988 | Japan | 101/425 |

*Primary Examiner*—Edgar S. Burr
*Assistant Examiner*—Anthony H. Nguyen
*Attorney, Agent, or Firm*—Darby & Darby

[57] ABSTRACT

An apparatus to apply cleaning fluid to a cylinder of a rotary printing machine with a controlled supply to the exit openings of a distributor device, from which the cleaning fluid can be sprayed on the cylinder with a specific time and space distribution. Guide elements to dam the jet are provided in front of and behind the region of the spray jet so as to limit this region toward the outside. The guide elements are attached to the distributor device and bridge over the distance between the distributor device and the convex surface of the cylinder, while forming narrow gaps between the guide elements and the convex cylinder surface. There is a flow labyrinth at least in the downstream gap.

10 Claims, 2 Drawing Sheets

CLEANING APPARATUS FOR A CYLINDER OF A ROTARY PRINTING MACHINE

FIELD OF THE INVENTION

The invention relates to a cleaning apparatus for a cylinder of a rotary printing machine. The cleaning apparatus is used especially to clean an impression cylinder or a blanket cylinder of a printing machine.

BACKGROUND OF THE INVENTION

Cleaning devices for printing machines are known in general, for example, from U.S. Pat. No. 3,084,626. In this known apparatus, the guide elements are situated at a distance next to the spray jets, so that they do not limit the spray jet but only prevent fluid particles from unintentionally spraying on adjacent machine parts.

Further, U.S. Pat. No. 3,900,003 discloses a fluid application apparatus for applying developer fluid on a cylinder in a multi-color electrophotography copying machine. The AT-PS 282 662 discloses a damping cylinder, which has a cylinder section that dips into a container with cleaning fluid and a section which adjoins the cylinder of a printing machine that is to be cleaned. The cleaning fluid for rinsing the damping cylinder is sprayed on the area of the damping cylinder that rises above the fluid. This is done by means of two neighboring doctor blades at a distance from one another. DE-PS 12,40,885 discloses a suction box opposite an impression cylinder. The suction box can be pivoted about an axis parallel to the cylinder and forms a gap with the cylinder. Brushes are provided on the suction box at the gap inlet and at the gap outlet. In the region between these brushes, the suction box has suction holes for suctioning dust from the surface of the paper that is to be printed and which runs around the cylinder surface. German Utility Patent 1,996,060 discloses an apparatus for spraying fluid into the gap between two rolls in the printing mechanism of an offset printing machine, in order to moisten its printing plates. The delivery of fluid is controlled in pulse-like fashion by a control device of the printing machine, depending on the printing speed and a selectable factor, as well as on a selectable spray timing. Further, DE-OS 34 46 757 A1 discloses a coating device for coating paper webs. This device forms an ink-application back-up space opposite the paper web that is being guided by the cylinder. This space is equipped with a labyrinth overflow seal against the direction of rotation of the paper web and of the cylinder.

Cleaning devices of this type are used to dissolve the dirt which collects during the printing process and which adheres to the cylinder surface. With customary rotary printing machines, a doctor blade or a cloth which absorbs the dirt with solvent is used to remove the dirt that has been softened by the cleaning fluid. With web-fed rotary printing machines, the dirt is also removed directly by the web when the cylinder that is being subjected to the cleaning process is in direct contact with the unwinding web. Several principles are thus known for transferring the cleaning fluid to the convex cylinder surface. One principle is based on application by a damping process, and various saturated materials can be used for this. Another principle is based on the application of cleaning fluid with bristles or bristle rollers, with which the dirty convex surface is cleaned mechanically at the same time. Another principle is based on spraying cleaning fluid on the convex surface of the cylinder, in which the cleaning fluid is conveyed by its inherent pressure or by the pressure of a gaseous carrier medium.

The principle of spraying is widespread, because the spraying device, in contrast to the contacting application devices, does not come in contact with the dirt and furthermore can be switched on and off easily. The duration and power of the jet can also be adjusted easily. The disadvantage of spraying is that the surface which is being cleaned and which moves underneath the jet sometimes is not wetted as well as with damping devices. Furthermore, the rebound or splatter effects and evaporation of the washing fluid occur, as a result of which portions of the fluid intended for the convex cylinder surface are lost. The fluid quantities which do not make a hit and which do not moisten the cylinder reach undesirable points of the printing machine and sometimes cause undesirable effects such as corrosion or interference with the printing carrier. The fluid which causes undesirable wetting collects in remote moistened points and forms droplets which can reach the printing carrier.

The waste of cleaning fluid is also unavoidable for kinematic reasons, because the motion and the forces of the fluid jet towards the rotating cylinder do not yield a perfect transfer of fluid into a wetting film. Droplets which strike the surface of the cylinder bounce off at various angles.

SUMMARY OF THE INVENTION

It is an object of the invention to keep the loss of cleaning fluid as low as possible, and to design the transfer of fluid to the convex cylinder surface during the spraying process more efficiently.

This and other objects and advantages are achieved by the following embodiments of the present invention.

The cleaning apparatus contains a distributor for spraying cleaning fluid on the cylinder under automatic control, and guide elements, which extend next to the spray jet from the distributor to the cylinder. The guide elements form a narrow gap between themselves and the cylinder behind and in front of the spray jets, such that the rear gap is the first gap in the direction of rotation of the cylinder, and the front gap is the second gap in the direction of rotation of the cylinder.

The decompression of the cleaning fluid which emerges under pressure and its disordered distribution are attenuated by closing at least part of the transfer path by a comb-like structure. The shielding of the transfer space between the spraying device and the convex surface of the cylinder affects the pressure pattern which extends from the point of the still prevailing interior pressure in the line at the outflow opening up to the rotating convex surface. The flow pressure is influenced by prescribing the flow cross-sections of the chamber which extends up to the cylinder. The pressure equalization with the ambient pressure at the unavoidable opening at the gap formed at the conjunction of the shielding, the environment, and the rotated convex cylinder surface, is accomplished by a labyrinth seal, with which the flow energy is reduced to a remnant. Since the pressure difference between the shielded space and the environment is small, little fluid emerges into the environment, with most going to the cylinder surface. For space considerations, small dimensions of the damming device are desirable. This means that only small dimensions are available for a flow path with the greatest possible pressure loss. The flow cross-section is therefore kept small, and as many corners as possible are provided.

The pressure of the cleaning fluid is relieved in a distributor device with parallel spacing, which extends to the convex cylinder surface, and which has a first rear gap in the direction of rotation of the cylinder and a second forward gap. In the direction of rotation of the cylinder, a large quantity flows off, because a suction effect prevails in this direction, especially if the cylinder has a rather great rotational speed. To counter the increased emergence of spray mist at the gap which is toward the direction of rotation, the respective labyrinth is designed longer on this side. With a mechanically similar design of the labyrinth, the labyrinth element that is toward the direction of rotation is longer than the rearward labyrinth element.

Wetting cleaning fluid, which collects at the surfaces of the labyrinth, can be removed by controlled drainage so that it will not drain out in an undesirable way at the end of the application phase. Accordingly, the distributor device and the guide elements are tilted and the draining substance is conducted to a sump.

In the simplest case, the guide elements consist of a lining which bridges over the intermediate space between the distributor device and the cylinder, with a front and rear chamber wall as viewed in the direction of rotation. A braided screen can be disposed at the free, non-contacting edges of the lining, which is situated opposite the convex cylinder surface. This screen separates off the mist droplets and is a "flow baffle".

More effective is a labyrinth design with axially directed flutings or grooves next to protrusions or edges. An alternating pressure profile exists from protrusion to groove or from peak to valley. Less fluid remains hanging at the labyrinth walls than in the braided screen. Additional damming is achieved by the double-wall structure of the labyrinth elements that have apertures or holes into the interior of the double wall. This creates another escape path for the fluid, the mist, and the fluid pressure.

Besides making the distributor device with its attached labyrinth elements tiltable for the controlled drainage of residual fluid, one can make the distributor device movable between a working position and a resting position. The labyrinth elements over the entire application apparatus can be designed to pivot so that they occupy minimal space in their resting position.

BRIEF DESCRIPTION OF THE DRAWINGS

The invention is described below by way of preferred embodiments, making reference to the drawings.

DETAILED DESCRIPTION OF THE PREFERRED EMBODIMENTS

A distributor 2 is disposed adjacent and axis-parallel to a cylinder 1 of a printing unit of a printing machine. The cylinder 1 here is a blanket cylinder. The distributor 2 has exit openings 3, through which cleaning fluid can be applied to the cylinder 1 over its entire width. The exit openings 3 consists of a number of holes or longitudinal slots. To prevent the after-flow of cleaning fluid after a controlled spray or jet interval has been completed, the exit openings 3 can be equipped with blocking needles or blocking covers which can be activated mechanically or electronically.

The cylinder 1 rotates in the direction of arrow Z, in which the cleaning fluid applied to its convex outer surface is also transported. A flow caused by the moving convex surface of the cylinder 1 runs in the direction Z. Depending on the viscosity of the solvent medium, which in the preferred case is ambient air combined with a spray mist and solvent vapor, this flow reaches a certain thickness. Cleaning fluid exiting from the exit openings 3 falls from the inherent pressure in the distributor 2 to the value of the ambient pressure. It thereby breaks up or creates vortices and is carried along in the direction of arrow Z with the moving convex surface of the cylinder 1.

Figure 1:
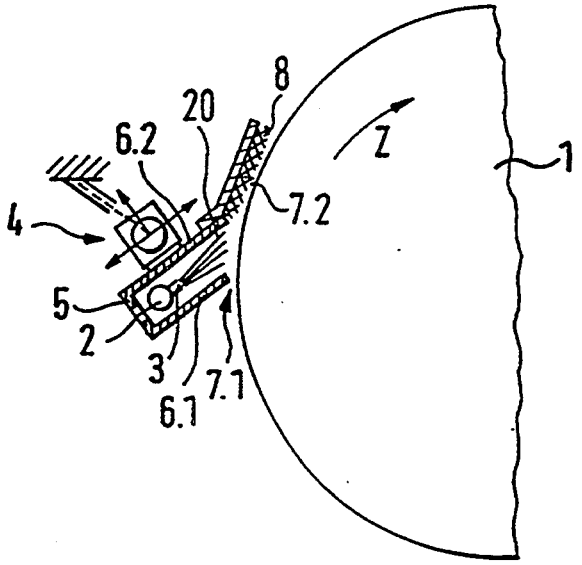
FIG. 1 shows the cleaning apparatus with a distributor in a chamber housing.

In FIG. 1, the distributor 2 is designed as a pipe. This pipe 2 is taken up in a U-shaped chamber-housing 5. The chamber-housing 5 is fastened to the side walls of the printing machine by an adjustable mount 4. The opening of the chamber-housing 5 points radially toward the cylinder 1, or is positioned at a slant in such a fashion that the flow direction of the exiting cleaning fluid is partially tangential in the direction of rotation Z. A certain dynamic pressure arises outside of the housing 5, between the convex surface of the cylinder 1 and a rear wall 6.1 of the chamber-housing 5. This pressure escapes through the distributor 2 in the direction of rotation and carries away the spray mist which would otherwise escape through the rear gap 7.1 between the rear wall 6.1 and the convex cylinder surface. The gap 7.1 between the rear wall 6.1 and the cylinder 1 is designed to be narrow. If the chamber-housing 5 is set at a slant in the direction of rotation Z, the covering front wall 6.2 is appropriately longer so that the front wall 6.2 of the chamber-housing 5 extends right up to the convex surface but does not touch it. The front wall 6.2 prevents the droplets of cleaning fluid from exiting freely in the direction of rotation Z at the frontal gap 7.2. The cleaning fluid that is sprayed out of the exit openings 3 usually takes its path through the frontal flow gaps 7.2, except for a mist which condenses in the chamber-housing 5. To reduce the amount of mist at the frontal flow gap 7.2, it is possible to affix a braided screen 8 to form a partially open, lossy exit cross-section at the frontal flow gap 7.2. The mist or the drops are forced to escape through the many mutually displaced free cross-sections, or pores of the screen.

Figure 2:
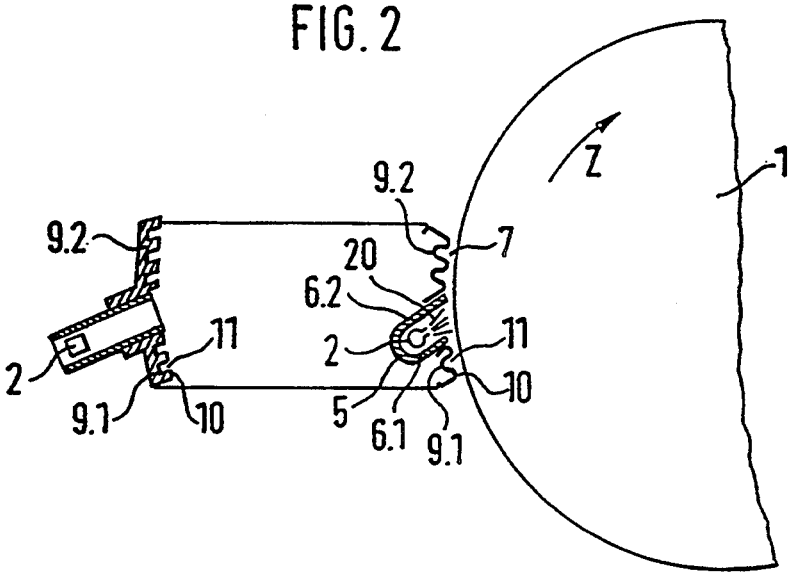
FIG. 2 shows a distributor with attached labyrinth elements.

In the embodiment of FIG. 2, the function of the braided screen 8, together with the frontal wall 6.2 of the chamber-housing 5, is replaced by a frontal labyrinth element 9.2. The frontal labyrinth element 9.2 on its front side, as viewed in the direction of rotation Z, adjoins closely to the distributor 2 and again forms a complex flow path for the frontal flow gap 7.2. Viewed tangentially, it has a corrugated or cornered design, so that alternating narrow and wide gaps result at the axially directed protrusions 10 and grooves 11. The cleaning fluid exiting from the distributor 2 wets the convex surface of the cylinder 1. The fluid also partially wets the frontal labyrinth element 9.2, and the flowing portion runs through the flow labyrinth with a changing pressure pattern, such that relatively lower and higher pressures alternate at the alternating narrow or wide labyrinth cross-sections.

Viewed opposite the direction of rotation Z, a rearward labyrinth element 9.1 is then also flanged onto the distributor 2. The rearward labyrinth element 9.1 performs the same function as the forward labyrinth element 9.2, with the difference that the relevant component of cleaning fluid exiting from the distributor 2 and escaping rearward, is significantly less. The decreased flow restriction that must be provided opposite the rotation is embodied by a shorter rearward labyrinth element 9.1.

Figure 3:
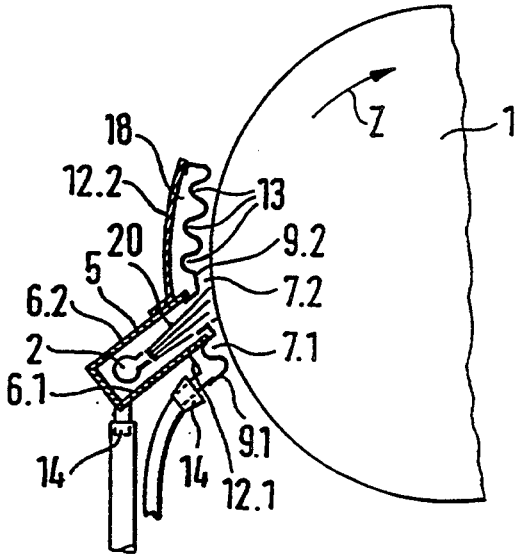
FIG. 3 shows a distributor with double-walled labyrinth elements.
Figure 4:
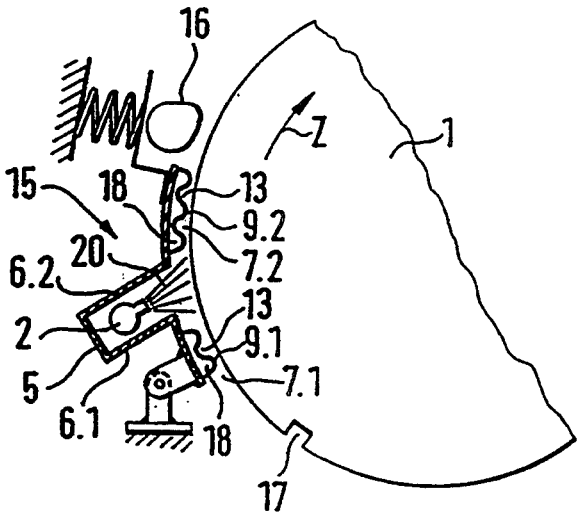
FIG. 4 shows a distributor with an adjustable spacing.

In the double-walled design of FIG. 3, the encapsulating walls 12.1, 12.2 are placed on the existing profile of the labyrinth elements 9.1, 9.2. This profile causes the pressure loss. The apertures 13 permit droplets to enter tile buffer spaces 18 that are formed in this way. Consequently, another flow path through the aperture 13 is added so that the droplets can flow away through the labyrinth along the flow gaps 7.1 and 7.2. Droplets escaping through these apertures 13, which are not transported to the convex surface of the cylinder 2, are discharged from the interior spaces 18 through outlets 14. The outlets 14 can be connected to a sump (not shown) through a common discharge line.

If the encapsulating walls 12.1, 12.2 are likewise provided with penetrations, the lossy flow path runs through the apertures 13 into the interior and on again to the outside. The exiting components of cleaning fluid here must be collected at the outer wall of the encapsulating walls 12.1, 12.2 and must be drained off. Experience will indicate the distance of the apertures 13 from the distributor 2 as well as their diameter.

The advantage of a double-walled structure is that blocking or supplementary media can be introduced into the buffer spaces, and can be conducted forward through the apertures. A vacuum can also be applied to the capsules, and thus excess mist can be suctioned off. This expensive measure is advantageous primarily if the mist is formed only in brief phases.

The labyrinth elements 9.1,9.2 create a shielding for the jet region of the distributor 2. Without further equipment, a channel 17 in the convex surface of the cylinder 1 would take up more cleaning fluid as it passes under the labyrinth element 9.1, 9.2. More cleaning fluid can be prevented from entering into the channel 17 if an application bar 15 can be lifted through an appropriately synchronized motion of a curved control element 16, which can be formed by a cam or by a cam protrusion. When the application bar 15 is lifted, the flow labyrinth or its flow gap 7.1,7.2 is expanded on one side. This is done by enlarging, on one side, the distance of the rear labyrinth element 9.1 or of the frontal labyrinth element 9.2 relative to the cylinder 1, or by enlarging the distance of both labyrinth elements 9.1 and 9.2 from the cylinder, in such a fashion that the pressure that is responsible for cleaning fluid entering channel 17 vanishes. In addition, if the application bar 15 is pivoted suddenly, the liquid jet turns during the pivoting action. If it is moved opposite the direction of rotation Z the amount of cleaning fluid associated with the channel area is reduced. In this way, the channel 17 thus receives less cleaning fluid than the extended areas of the convex surface of the cylinder 1. The motion of the curved control element 16 is controlled by a control device of the printing machine.

In FIGS. 1 through 4, identically or functionally corresponding parts carry the same reference numbers.

The spray jet 20 of the distributor 2 preferably is controlled automatically by the printing machine. The duration, the flow rate and amount of fluid, the spray direction and/or the impact area of the spray jet 20 on the cylinder 1 can be controlled. The apparatus of the present invention makes it possible for the cleaning fluid to be sprayed on the cylinder in a specified time distribution as well as in a specified spatial distribution or in the form of a sharp jet.

What is claimed is:

1. A cleaning apparatus for a cylinder of a rotary printing machine, especially for an impression cylinder or a blanket cylinder, comprising:

a distributor (2) for spraying a jet of cleaning fluid on the cylinder (1);

at least two guide elements (6.1, 6.2) extending adjacent to the spray jet (20) from the distributor (2) to the cylinder (1), each of said guide elements positioned adjacent said cylinder (1) to form a narrow gap therewith, one of said guide elements forming a rear gap (7.1) being the first gap along the direction of rotation of the cylinder (1), the other of said guide elements forming a front gap (7.2) being the second gap along the direction of rotation of the cylinder (1);

wherein the guide elements (6.1, 6.2) are disposed directly adjacent said spray jet such that said spray jet is conducted from said distributor to said cylinder substantially without additional air;

wherein the guide elements (6.1, 6.2) extend approximately parallel to the direction of the spray jet (20);

wherein a flow labyrinth (9.2, 9.3) is provided at the forward gap (7.2) and the rearward gap (7.1) to separate off a mist of said cleaning fluid.

2. The cleaning apparatus of claim 1 wherein the guide elements (6.1, 6.2) form a housing (5) and wherein the distributor (2) is housed in the housing (5).

3. The cleaning apparatus of claim 1 wherein the labyrinth (9.2) at the forward gap (7.2) is longer than the labyrinth (9.1) at the rearward gap (7.1).

4. The cleaning apparatus of claim 3 wherein the walls of the flow labyrinth (7.1, 7.2) have drainage openings (13) to discharge the cleaning fluid and to separate the cleaning-fluid mist from the gap (7.1, 7.2) into a drainage chamber (18), which is situated downstream from the drainage openings (13).

5. The cleaning apparatus of claim 4, further comprising a means for adjusting such that the labyrinth elements (9.1, 9.2) and the distributor (2) can be adjusted to various distances from the cylinder (1).

6. The cleaning apparatus of claim 1, further comprising a means for adjusting such that the labyrinth elements (9.1, 9.2) and the distributor (2) can be adjusted to various distances from the cylinder (1).

7. The cleaning apparatus of claim 6 wherein the flow labyrinth is formed by a braided screen (8).

8. The cleaning apparatus of claim 7 wherein the distributor (2) together with the guide elements (6.1, 6.2) and the labyrinth elements (9.1, 9.2) are automatically lifted as they pass by a channel (17) which is formed in the circumference of the cylinder (1) and, after passing by the channel (17), are automatically lowered again into their original position.

9. The cleaning apparatus of claim 6 wherein the flow labyrinth is formed by an arrangement (9.1, 9.2) of alternating corrugation peaks (10) and corrugation valleys (11 ), which extend parallel to the cylinder (1).

10. The cleaning apparatus of claim 9 wherein the distributor (2) together with the guide elements (6.1, 6.2) and the labyrinth elements (9.1, 9.2) are automatically lifted as they pass by a channel (17) which is formed in the circumference of the cylinder (1) and, after passing by the channel (17), are automatically lowered again into their original position.

* * * * *